US007426889B2

(12) United States Patent
Luger et al.

(10) Patent No.: US 7,426,889 B2
(45) Date of Patent: Sep. 23, 2008

(54) CLAMPING DEVICE FOR COUPLING TRANSPORT DEVICES

(75) Inventors: Peter Luger, Dornbirn (AT); Bernd Meindl, Hard (AT)

(73) Assignee: Innova Patent GmbH, Wolfurt (AT)

( * ) Notice: Subject to any disclaimer, the term of this patent is extended or adjusted under 35 U.S.C. 154(b) by 258 days.

(21) Appl. No.: 11/267,099

(22) Filed: Nov. 4, 2005

(65) Prior Publication Data

US 2006/0107864 A1 May 25, 2006

(30) Foreign Application Priority Data

Nov. 4, 2004 (AT) ..... 1842/2004

(51) Int. Cl.
*B61B 12/12* (2006.01)

(52) U.S. Cl. ..... 104/202; 104/206

(58) Field of Classification Search ..... 104/173.1, 104/180, 202, 206, 208, 209, 211, 216, 223
See application file for complete search history.

(56) References Cited

U.S. PATENT DOCUMENTS

| | | | | | |
|---|---|---|---|---|---|
| 498,325 | A | * | 5/1893 | Taylor | 104/216 |
| 614,380 | A | * | 11/1898 | Frigard | 104/180 |
| 655,519 | A | * | 8/1900 | Sackett | 104/206 |
| 3,416,462 | A | * | 12/1968 | Pomagalski | 104/202 |
| 4,031,830 | A | * | 6/1977 | Hirt et al. | 104/223 |
| 4,120,247 | A | * | 10/1978 | Muller et al. | 104/208 |
| 4,297,951 | A | * | 11/1981 | Laurent | 104/209 |
| 4,653,406 | A | * | 3/1987 | Levi | 104/211 |
| 4,741,272 | A | * | 5/1988 | Tarassoff | 104/173.1 |
| 4,760,798 | A | * | 8/1988 | Blengini | 104/209 |
| 5,452,662 | A | | 9/1995 | Switzeny | |
| 6,024,022 | A | | 2/2000 | Toyre | |
| 6,290,425 | B1 | * | 9/2001 | Cathiard et al. | 104/209 |
| 6,321,658 | B1 | * | 11/2001 | Pabst et al. | 104/202 |
| 6,543,366 | B2 | * | 4/2003 | Pabst et al. | 104/202 |

FOREIGN PATENT DOCUMENTS

| | | |
|---|---|---|
| AT | 404 458 B | 11/1998 |
| DE | 2500979 A1 | 7/1976 |
| EP | 0852198 A1 | 7/1998 |
| GB | 984003 | 2/1965 |
| GB | 1497202 | 1/1978 |

* cited by examiner

*Primary Examiner*—Lars A Olson
(74) *Attorney, Agent, or Firm*—Laurence A. Greenberg; Werner H. Stemer; Ralph E. Locher

(57) ABSTRACT

A clamping device for coupling a transport device, for example a cabin, gondola, or a chair, to the hauling or traction cable of a cableway system. The clamping device contains two clamping jaws that can be moved toward one another or apart for coupling the clamping device to and uncoupling it from the hauling or traction cable. Exchangeable jaws, via which the clamping jaws act on the hauling or traction cable, are fastened to the clamping jaws. A bearing surface on the clamping jaws for the exchangeable jaws is curved concavely, and a counter surface on the exchangeable jaws has a corresponding curvature.

19 Claims, 2 Drawing Sheets

CLAMPING DEVICE FOR COUPLING TRANSPORT DEVICES

BACKGROUND OF THE INVENTION

Field of the Invention

The invention relates to a clamping device for coupling a transport device, for example a cabin, a gondola or a chair, to the hauling or traction cable of a cableway system. The clamping device has two clamping jaws which can be moved toward one another or apart for coupling the clamping device to and uncoupling it from the hauling or traction cable. The clamping device has exchangeable jaws, via which the clamping jaws act on the hauling or traction cable, being fastened to the clamping jaws.

In clamping devices for coupling transport devices, for example cabins, gondolas, or chairs, to the hauling or traction cable of a cableway system, such as are known from Austrian patent AT 404 458 B for example, use is made of lever systems which act on the hauling or traction cable of the cableway system via clamping jaws. Owing to wear on the clamping jaws and on the cable, modification of the clamping device or replacement of the cable, it may be necessary either to remachine the clamping jaws or, if this is not possible, to replace them completely. In order to avoid this, it has already been proposed to mount exchangeable jaws, which bore against the clamping jaws via a plane bearing surface and were fastened there, on the clamping jaws. While this form of exchangeable jaws solved the problem of remachining or replacing the clamping jaws, the configuration nevertheless meant that there was a relatively great material requirement for the clamping jaws and the exchangeable jaws, and the seating of the exchangeable jaws on the clamping jaws was not entirely satisfactory either.

SUMMARY OF THE INVENTION

It is accordingly an object of the invention to provide a clamping device for coupling a transport device which overcomes the above-mentioned disadvantages of the prior art devices of this general type.

With the foregoing and other objects in view there is provided, in accordance with the invention, a clamping device for coupling a transport device to a hauling or traction cable of a cableway system. The clamping device contains two clamping jaws moveble toward one another or apart for coupling the clamping device to and uncoupling the clamping device from the hauling or traction cable. Exchangeable jaws, through which the clamping jaws act on the hauling or traction cable, are fastened to the clamping jaws. The clamping jaws have a bearing surface for receiving the exchangeable jaws, the bearing surface is curved concavely. The exchangeable jaws have a counter surface with a curvature corresponding to the bearing surface.

Owing to the concavely curved bearing surface on the clamping jaws, or the associated and correspondingly convexly curved counter surface on the exchangeable jaws, both problems are solved at once. On the one hand, the exchangeable jaws have an substantially cylindrical cross-sectional shape, so that material can be saved on the exchangeable jaws in comparison with the prior art, and, on the other hand, very good seating of the exchangeable jaws on the clamping jaws is brought about by virtue of the arched curvature of the bearing surface and counter surface.

In a preferred embodiment of the invention, the bearing surface and the counter surface are curved with a circular cylindrical shape. This embodiment results in surfaces that are easy to produce and, as mentioned, good seating.

A further preferred embodiment of the invention is characterized in that the contact surface with which an exchangeable jaw acts on the hauling or traction cable has a shape that is substantially parallel to the counter surface.

As the cable has a round cross section, the radius of curvature of which is greater than the radius of curvature of the contact surface in the central curvature region, a contact region which is formed of two strip-shaped contact surfaces spaced from one another is brought about on each exchangeable jaw, by virtue of which very good contact between cable and exchangeable jaws is achieved.

In a development of the invention, provision can be made in this connection that the radius of curvature of the contact surface increases outward from the central region and in particular merges with a substantially plane region.

Alternatively or additionally, provision can be made that the contact surface contains groove-shaped depressions or a slot-shaped depression in the central region. Contact regions, with which the exchangeable jaws bear against the cable in an accurately defined way, are produced above and below this slot or these grooves.

In order to fasten the exchangeable jaws to the clamping jaws, provision can be made, as is known per se, that the exchangeable jaw contains two cheeks that extend laterally next to the clamping jaws.

In a preferred development of the invention, provision can be made in this connection that the cheeks contain a shoulder on the sides facing one another, the distance between projections of the shoulder of the two cheeks being smaller than the distance between returns on the cheeks.

By virtue of the shoulders or the projections, the contact region on the clamping jaws can be defined very accurately on the cheeks, which results in accurately calculable loading conditions on the exchangeable jaws.

In this connection, it is preferred within the scope of the invention if the projection is disposed in the region next to the counter surface of the exchangeable jaw.

This embodiment affords the advantage that shear forces acting on the exchangeable jaws in the longitudinal direction of the cable exert only very small bending forces on the cheeks, by virtue of which the loading in the critical transition region between counter surface and cheeks can be kept small, which further results in favorable dimensioning of the exchangeable jaws.

In this connection, it is preferred within the scope of the invention if the width of the projection is approximately 15-50%, preferably 20-30%, of the width of the cheek.

As is known per se from the prior art, the exchangeable jaws are connected to the clamping jaws via sleeves which are inserted through mounting bores in the cheeks and into corresponding bores in the clamping jaws and are screwed tight there. With this form of fastening, it is preferred within the scope of the invention if the projection extends as far as approximately into the region of a mounting bore or slightly into the region of the mounting bore, as in this way the fastening arrangements, that is the sleeves and the screws, are exposed to only very small loads when force transmission takes place from the exchangeable jaws to the clamping jaws.

Other features which are considered as characteristic for the invention are set forth in the appended claims.

Although the invention is illustrated and described herein as embodied in a clamping device for coupling a transport device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings

DESCRIPTION OF THE PREFERRED EMBODIMENTS

Figure 1:
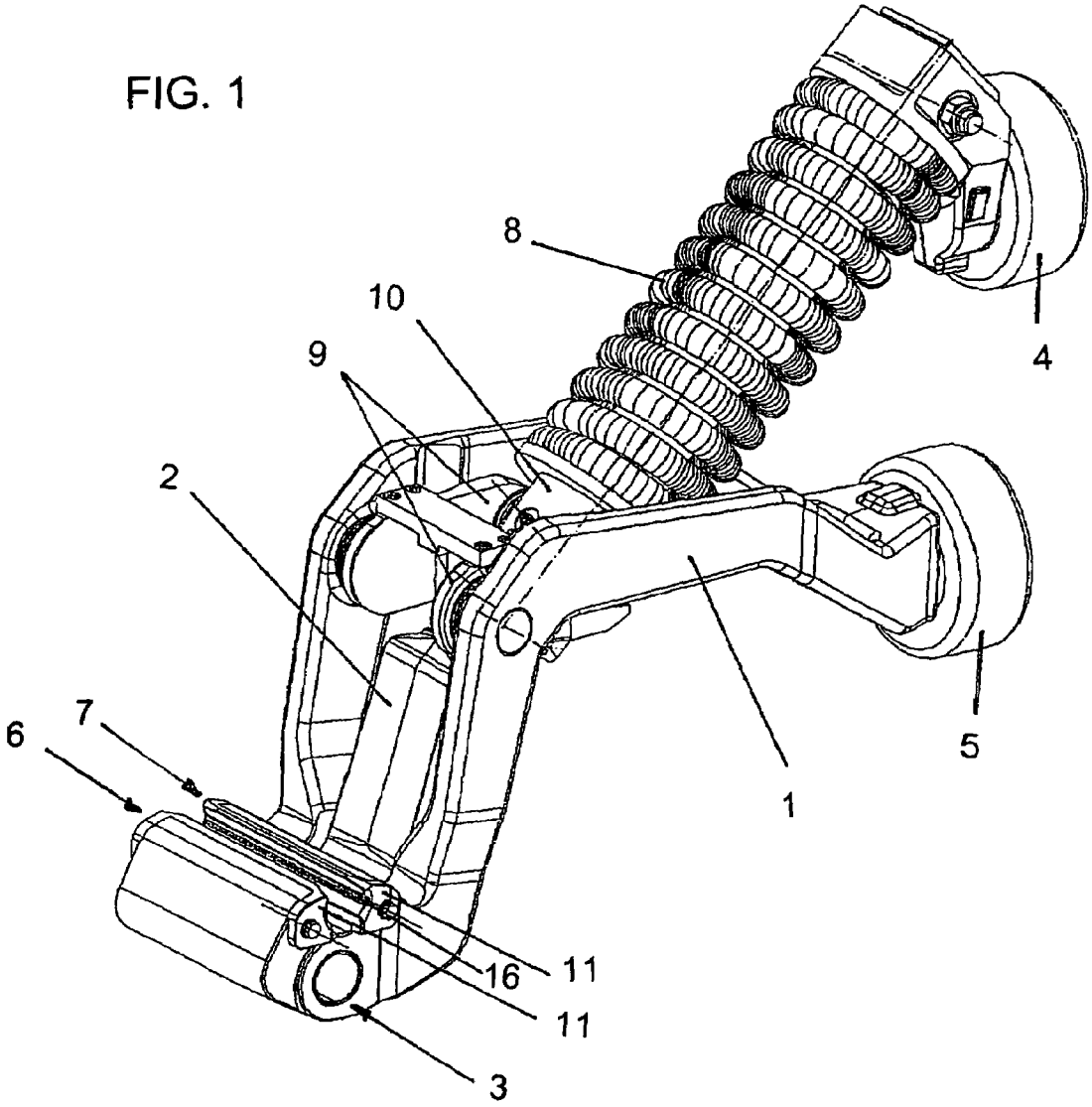
FIG. 1 is a diagrammatic, perspective view of a clamping device according to the invention.
Figure 3:
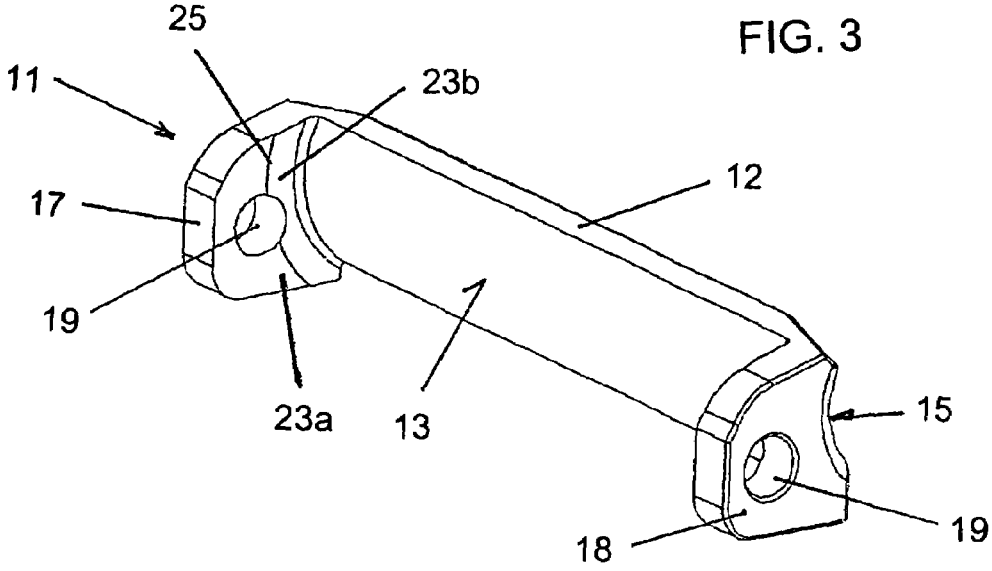
FIG. 3 is a diagrammatic, perspective view of an exchangeable jaw.
Figure 2:
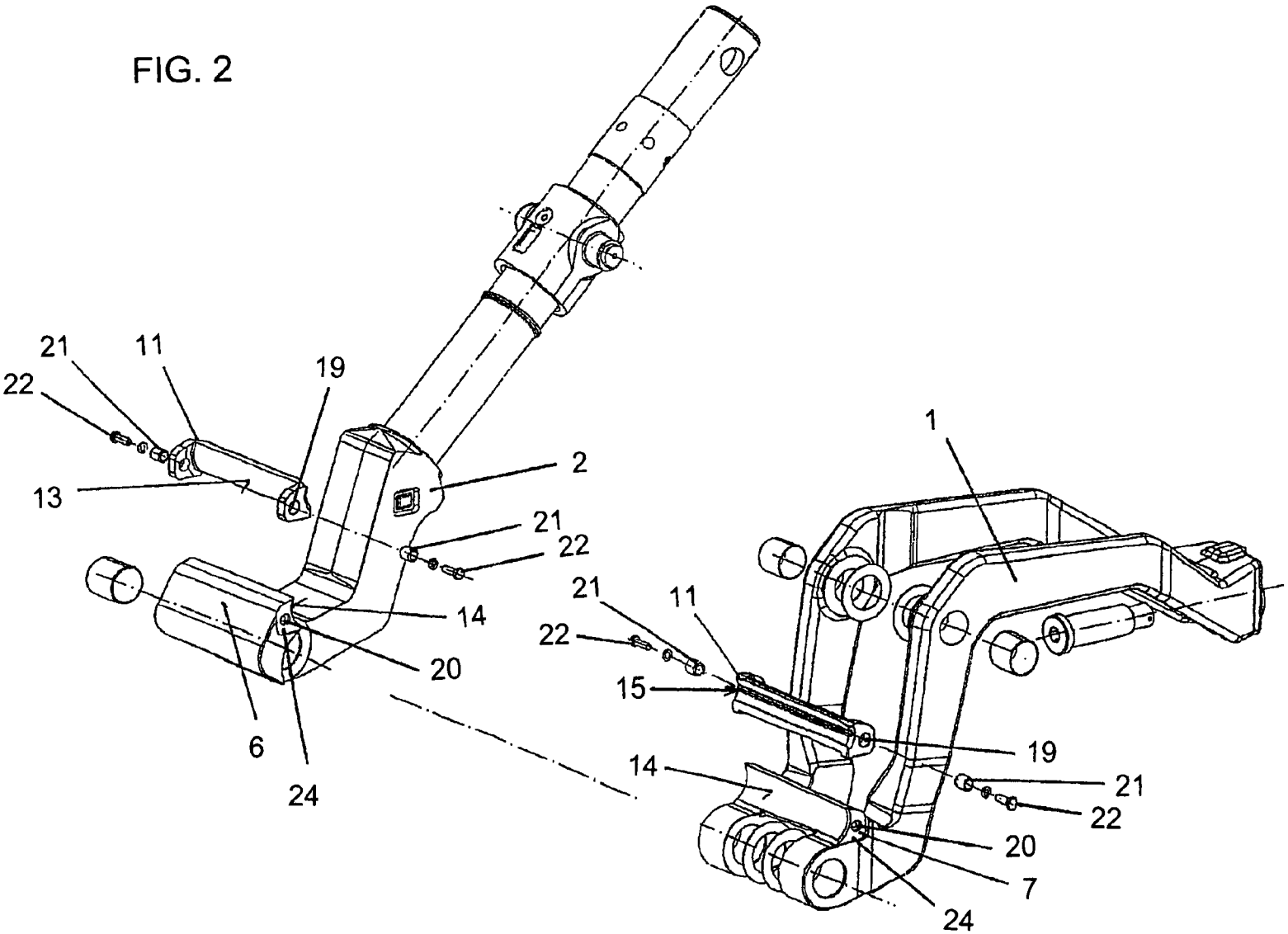
FIG. 2 is a diagrammatic, perspective view of a part of the clamping device from FIG. 1 in a dismantled state.

Referring now to the figures of the drawing in detail and first, particularly, to FIG. 1 thereof, there is shown a clamping device which, as is known per se from Austrian patent AT 404 458 B, contains two clamping levers 1 and 2, which are interconnected at a joint 3. A roller 4, 5 is mounted on each clamping lever 1, 2; the rollers run partly along guide rails in the stations of a cableway. With a suitable course of these guide rails, the clamping levers 1, 2 can be pivoted in relation to one another by the rollers 4, 5, by virtue of which clamping jaws 6, 7 can be moved toward one another or apart as the clamping jaw 6 is attached to the clamping lever 2 and the clamping jaw 7 is attached to the clamping lever 3. In FIG. 1, the clamping device is illustrated in the closed position, in which a non-illustrated cable would be clamped firmly between the clamping jaws 6, 7. If the clamping levers 1, 2 are pivoted by the rollers 4, 5, moving apart, a spring 8 on the clamping lever 2 is compressed and thus still further prestressed by a toggle lever pair 9 which is mounted in an articulated manner on the clamping lever 1 and the other end of which is guided displaceably on the clamping lever 2 by a sleeve 10. At the same time, the clamping jaws 6, 7 are opened and the non-illustrated cable would be released.

As the clamping jaws 6, 7 are subject to wear in their contact region with the cable, this wear on the contact surfaces has to be compensated for at regular intervals. It can also occur that the cable diameter changes owing to replacement of the cable, whether because of maintenance or for other reasons. In this case as well, the clamping jaws 6, 7 can be adapted to the new cable diameter very easily with the aid of the invention.

In order for it to be possible to carry this out in a simplified manner, exchangeable jaws 11 are mounted on the clamping jaws 6, 7. The exchangeable jaws contain a central part 12 which has on its rear side a cylindrically curved counter surface 13 for a correspondingly curved bearing surface 14 on each clamping jaw 6, 7. The contact surface 15 on that side of the central part 12 facing the cable has a shape which is substantially but not entirely parallel to the counter surface 13. The contact surface 15 contains a central region on which a longitudinally extending slot 16 or grooves are provided. Contact regions with which the exchangeable jaws 11 bear flat against the cable in a defined way are located above and below this slot 16 or these grooves. This configuration of the contact surfaces results in very reliable clamping action.

Alternatively, it would also be possible to configure the contact surface in the central region with a radius of curvature that is smaller than the radius of the cable. The radius of curvature then increases outward, that is at the top and at the bottom toward the longitudinal edges of the central region 12, so that the exchangeable jaws 11 are applied against the cable only in these regions with a larger radius of curvature. Very reliable clamping action can also be achieved in this way.

For fastening the exchangeable jaws 11 to the clamping jaws 6, 7, the exchangeable jaws 11 contain cheeks 17, 18 which extend laterally next to the clamping jaws 6, 7. A bore 19 is provided in each cheek, and a bore 20 is provided on each side of the clamping jaws 6, 7. A sleeve 21 is inserted through the bore 19 in each cheek 17, 18 and into each bore 20 in the clamping jaws 6, 7 and is then screwed tight to the clamping jaws 6, 7 with a screw 22. The exchangeable jaws 11 are therefore fixed to the clamping jaws 6, 7 only with the aid of these sleeves 21, these sleeves not having to transmit any appreciable forces, as the exchangeable jaws 11 are held very well force-lockingly and form-lockingly by the concavely curved bearing surfaces 14 on the clamping jaws 6, 7 and the correspondingly convexly curved counter surfaces 13 on the exchangeable jaws 11 in the transverse direction to the longitudinal extent of the cable or of the exchangeable jaws 11 and by the frictional forces acting between these surfaces 13, 14.

In order to transmit the forces acting in the longitudinal direction of the cable as well positively from the exchangeable jaws 11 to the clamping jaws 6, 7, the cheeks bear with their surfaces 23 facing the clamping jaws 6, 7 against the associated surfaces 24 of the clamping jaws 6, 7 with small play. In order to prevent undesirably high bending forces acting on the cheeks 17, 18, or the transition region between the cheeks 17, 18 and the central part 12, the inner surfaces 23 of the cheeks 17, 18 contain a shoulder 25, the distance between projections 23*b* of the shoulder 25 of the two cheeks 17, 18 being smaller than the distance between returns 23*a*. Consequently, the cheeks actually bear against the side surfaces 24 of the clamping jaws 6, 7 only with the regions 23*b* lying close to the counter surface 13. The longitudinal forces to be transmitted from the clamping jaws 6, 7 via the cheeks 17, 18 to the central part 12 and on to the cable are therefore transmitted primarily as shear forces from the cheeks 17, 18 to the central part 12, the bending forces acting on the cheeks 17, 18, or on the transition region between the cheeks 17, 18 and the central part 12, being relatively small owing to the short lever arm, which has a positive effect on loading and as a further result dimensioning of the exchangeable jaws 11.

By virtue of the substantially parallel shape of the contact surface 15 on that side of the central part 12 facing the cable and of the counter surface 13 facing the clamping jaws 6, 7, the cross section of the central part of the exchangeable jaws 11 is substantially cylinder-wall-shaped, which results not only in a material saving in comparison with the known exchangeable jaws but also favorable loading and force-transmission conditions on the central part.

By virtue of this, it is also possible to find cost-effective solutions in the selection of the material for the exchangeable jaws which also form optimum combinations with regard to the friction and wear conditions as far as the material pairings between the clamping jaws 6, 7 and the exchangeable jaws 11 on the one hand and the exchangeable jaws 11 and the cable on the other hand are concerned.

This application claims the priority, under 35 U.S.C. §119, of Austrian patent application No. 1842/2004, filed Nov. 4, 2004; the entire disclosure of the prior application is herewith incorporated by reference.

We claim:

1. A clamping device for coupling a transport device to a hauling or traction cable of a cableway system, the clamping device comprising:

two clamping jaws moveble toward one another or apart for coupling the clamping device to and uncoupling the clamping device from the hauling or traction cable;

exchangeable jaws, through which said clamping jaws act on the hauling or traction cable, being fastened to said clamping jaws;

said clamping jaws having a bearing surface for receiving said exchangeable jaws, said bearing surface being curved concavely;

said exchangeable jaws having a counter surface with a curvature corresponding to said bearing surface and said counter surface resting on said bearing surface; and said exchangeable jaws each containing two cheeks extending laterally next to a respective one of said clamping jaws.

2. The clamping device according to claim 1, wherein said bearing surface and said counter surface are curved with a circular cylindrical shape.

3. The clamping device according to claim 1, wherein said exchangeable jaws have a contact surface with which said exchangeable jaws act on the hauling or traction cable and said contact surface has a shape substantially parallel to said counter surface.

4. The clamping device according to claim 3, wherein said contact surface has a discontinuous curvature profile with a radius of curvature in a central curvature region being smaller than a radius of curvature of the cable.

5. The clamping device according to claim 4, wherein said radius of curvature of said contact surface increases outward from said central curvature region and merges with a substantially plane region.

6. The clamping device according to claim 3, wherein said contact surface has a central region with groove-shaped depressions formed therein.

7. The clamping device according to claim 3, wherein said contact surface has a central region with a slot-shaped depression formed therein.

8. The clamping device according to claim 1, wherein said cheeks contain shoulders on sides facing one another, said cheeks having projections and returns on said shoulders, a distance between said projections of said shoulders of said two cheeks being smaller than a distance between said returns on said cheeks.

9. The clamping device according to claim 8, wherein said projections are disposed in a region next to said counter surface of said exchangeable jaws.

10. The clamping device according to claim 8, wherein said projections have a width being approximately 15-50% of a width of said cheeks.

11. The clamping device according to claim 9, wherein:

said cheeks each have a mounting bore formed therein; and said projections extend as far as approximately into a region of said mounting bore or slightly into said region of said mounting bore.

12. The clamping device according to claim 8, wherein said projections have a width being approximately 20-30% of a width of said cheeks.

13. The clamping device according to claim 1, wherein the transport device is a cabin, a gondola or a chair.

14. A clamping device for coupling a transport device to a hauling or traction cable of a cableway system, the clamping device comprising:

two clamping jaws moveble toward one another or apart for coupling the clamping device to and uncoupling the clamping device from the hauling or traction cable;

exchangeable jaws, through which said clamping jaws act on the hauling or traction cable, being fastened to said clamping jaws;

said clamping jaws having a concavely curved bearing surface for receiving said exchangeable jaws;

said exchangeable jaws having a counter surface with a curvature corresponding to said bearing surface and a contact surface with which said exchangeable jaws act on the hauling or traction cable, said contact surface having a shape substantially parallel to said counter surface and having a central region with a slot-shaped depression or groove-shaped depressions formed and therein; and said exchangeable jaws each containing two cheeks extending laterally next to a respective one of said clamping jaws.

15. A clamping device for coupling a transport device to a hauling or traction cable of a cableway system, the clamping device comprising:

two clamping jaws moveble toward one another or apart for coupling the clamping device to and uncoupling the clamping device from the hauling or traction cable;

exchangeable jaws, through which said clamping jaws act on the hauling or traction cable, being fastened to said clamping jaws, said exchangeable jaws each containing two cheeks extending laterally next to a respective one of said clamping jaws; and said clamping jaws having a bearing surface for receiving said exchangeable jaws, said bearing surface being curved concavely; and said exchangeable jaws having a counter surface with a curvature corresponding to said bearing surface.

16. The clamping device according to claim 15, wherein said cheeks contain shoulders on sides facing one another, said cheeks having projections and returns on said shoulders, a distance between said projections of said shoulders of said two cheeks being smaller than a distance between said returns on said cheeks.

17. The clamping device according to claim 16, wherein said projections are disposed in a region next to said counter surface of said exchangeable jaws.

18. The clamping device according to claim 16, wherein said projections have a width being approximately 15-50% of a width of said cheeks.

19. The clamping device according to claim 16, wherein:

said cheeks each have a mounting before formed therein; and said projections extend as far as approximately into a region of said mounting bore or slightly into said region of said mounting bore.

* * * * *